US008854120B2

(12) United States Patent
Temkine et al.

(10) Patent No.: US 8,854,120 B2
(45) Date of Patent: Oct. 7, 2014

(54) AUTO-CALIBRATING A VOLTAGE REFERENCE

(75) Inventors: Grigori Temkine, Marham (CA); Filipp Chekmazov, Toronto (CA); Oleg Drapkin, Richmond Hill (CA)

(73) Assignee: ATI Technologies ULC, Markham, Ontario (CA)

( * ) Notice: Subject to any disclaimer, the term of this patent is extended or adjusted under 35 U.S.C. 154(b) by 34 days.

(21) Appl. No.: 13/436,122

(22) Filed: Mar. 30, 2012

(65) Prior Publication Data

US 2013/0162341 A1 Jun. 27, 2013

Related U.S. Application Data

(60) Provisional application No. 61/579,370, filed on Dec. 22, 2011.

(51) Int. Cl.
*G05F 1/10* (2006.01)
*G05F 3/02* (2006.01)

(52) U.S. Cl.
USPC ..... 327/539

(58) Field of Classification Search
USPC ..... 327/512–513, 539; 323/313
See application file for complete search history.

(56) References Cited

U.S. PATENT DOCUMENTS

| | | | | |
|---|---|---|---|---|
| 6,351,159 | B1 * | 2/2002 | Huber et al. | 327/108 |
| 6,590,372 | B1 * | 7/2003 | Wiles, Jr. | 323/316 |
| 7,579,860 | B2 * | 8/2009 | Deken | 324/760.01 |
| 2008/0258804 | A1 * | 10/2008 | Kutz | 327/539 |
| 2010/0040111 | A1 * | 2/2010 | Cheng et al. | 374/170 |
| 2010/0052643 | A1 * | 3/2010 | Cho et al. | 323/313 |
| 2012/0081099 | A1 * | 4/2012 | Melanson et al. | 323/313 |
| 2013/0120930 | A1 * | 5/2013 | Temkine et al. | 361/679.47 |

OTHER PUBLICATIONS

Robert J. Widlar, New Developments in IC Voltage Regulators, IEEE Journal of Solid State Circuits, Feb. 1971, pp. 2-7, vol. SC-6, No. 1.

* cited by examiner

*Primary Examiner* — Quan Tra
(74) *Attorney, Agent, or Firm* — Volpe and Koenig, P.C.

(57) ABSTRACT

A method and circuitry for determining a temperature-independent bandgap reference voltage are disclosed. The method includes determining a quantity proportional to an internal series resistance of a p-n junction diode and determining the temperature-independent bandgap reference voltage using the quantity proportional to an internal series resistance.

26 Claims, 3 Drawing Sheets

AUTO-CALIBRATING A VOLTAGE REFERENCE

CROSS REFERENCE TO RELATED APPLICATION(S)

This application claims the benefit of U.S. provisional application No. 61/579,370, filed Dec. 22, 2011, which is incorporated by reference as if fully set forth herein.

FIELD OF THE INVENTION

The present invention is generally directed to electronics, and in particular, to integrated circuits.

BACKGROUND

Many electronic circuits require, for their proper operation, a highly stable voltage reference source that is insensitive to variables such as temperature and the variations of the supply voltage level. Bandgap reference voltage sources with such stable output voltages may be constructed based on the physics of semiconductor p-n junctions. Bandgap reference voltage sources must be carefully set, or calibrated, in order to provide such stable voltages of known value. The calibration is highly sensitive to variations in the fabrication process, and must therefore be performed on each instance of the bandgap reference circuit for the highest accuracy and stability. To do this during manufacturing, however, is costly and excessively time-consuming.

SUMMARY OF EMBODIMENTS

A method and circuitry for determining a temperature-independent bandgap reference voltage are disclosed. The method includes determining a quantity proportional to an internal series resistance of a p-n junction diode and determining the temperature-independent bandgap reference voltage using the quantity proportional to an internal series resistance.

BRIEF DESCRIPTION OF THE DRAWINGS

A more detailed understanding may be had from the following description, given by way of example in conjunction with the accompanying drawings wherein.

DETAILED DESCRIPTION OF THE EMBODIMENTS

Figure 1:
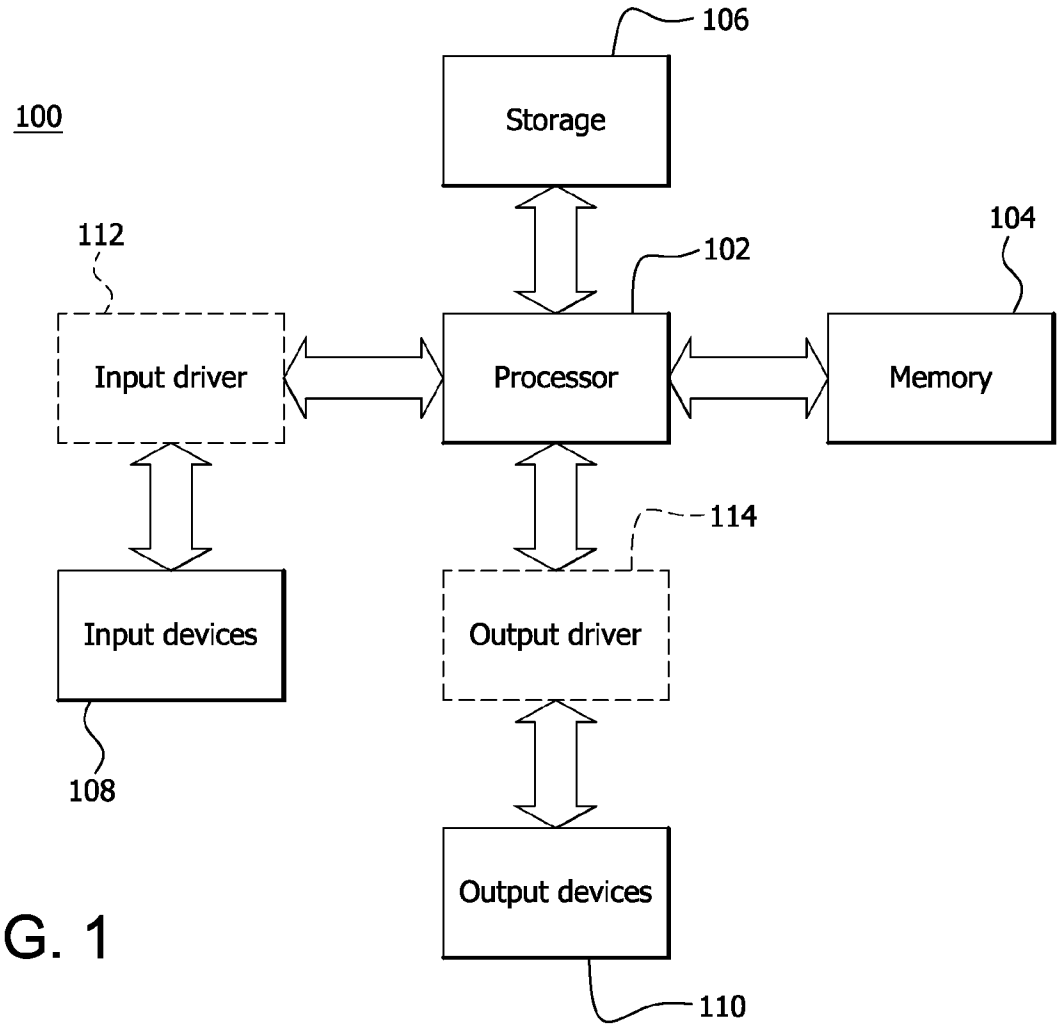
FIG. 1 is a block diagram of an example device in which one or more disclosed embodiments may be implemented.

FIG. 1 is a block diagram of an example device 100 in which one or more disclosed embodiments of a bandgap reference voltage source may be implemented. The device 100 may include, for example, a computer, a gaming device, a handheld device, a set-top box, a television, a mobile phone, or a tablet computer. The device 100 includes a processor 102, a memory 104, a storage 106, one or more input devices 108, and one or more output devices 110. As an example, an input device 108 may include an ADC that requires a stable voltage reference, as provided by an embodiment described hereinafter. The device 100 may also optionally include an input driver 112 and an output driver 114. It is understood that the device 100 may include additional components not shown in FIG. 1.

The processor 102 may include a central processing unit (CPU), a graphics processing unit (GPU), a CPU and GPU located on the same die, or one or more processor cores, wherein each processor core may be a CPU or a GPU. The memory 104 may be located on the same die as the processor 102, or may be located separately from the processor 102. The memory 104 may include a volatile or non-volatile memory, for example, random access memory (RAM), dynamic RAM, or a cache.

The storage 106 may include a fixed or removable storage, for example, a hard disk drive, a solid state drive, an optical disk, or a flash drive. The one or more input devices 108 may include a keyboard, a keypad, a touch screen, a touch pad, a detector, a microphone, an accelerometer, a gyroscope, a biometric scanner, or a network connection (e.g., a wireless local area network card for transmission and/or reception of wireless IEEE 802 signals). The one or more output devices 110 may include a display, a speaker, a printer, a haptic feedback device, one or more lights, an antenna, or a network connection (e.g., a wireless local area network card for transmission and/or reception of wireless IEEE 802 signals).

The input driver 112 communicates with the processor 102 and the one or more input devices 108, and permits the processor 102 to receive input from the one or more input devices 108. The output driver 114 communicates with the processor 102 and the one or more output devices 110, and permits the processor 102 to send output to the one or more output devices 110. It is noted that the input driver 112 and the output driver 114 are optional components, and that the device 100 will operate in the same manner is the input driver 112 and the output driver 114 are not present.

As stated hereinbefore, a bandgap voltage reference circuit may be used to provide a stable, temperature-independent voltage. In one type of bandgap voltage reference circuit a stable reference voltage is derived from a semiconductor p-n junction diode, such as the base-emitter diode of a bipolar transistor, also called a bipolar junction transistor or BJT. The diode may be the base-emitter diode of a p-n-p transistor in a CMOS circuit. Other suitable devices include, but are not limited to, homojunction p-n diodes, heterojunction diodes, pnp and npn homojunction BJTs, heterojunction BJTs, and all other devices which include one or more p-n junctions. Although descriptions presented here may include BJTs, they are not to be construed as limited to BJTs and the junctions contained therein.

In an embodiment, a first forward current $I_{d1}$ is applied to a first diode and a resulting forward voltage drop across the first diode $V_{be1}$ is measured. A second forward current $I_{d2}$ is applied to the same diode or to a second diode having essentially the same structure as the first diode, and a resulting forward voltage drop across the second diode $V_{be2}$ is measured. A stable bandgap reference voltage $V_{bg}$ may then be determined from Equation (1):

$$V_{bg}=V_{be1}+m*\Delta V_{be}. \quad \text{Equation (1)}$$

In Equation (1), $\Delta V_{be}=V_{be2}-V_{be1}$ and m is an adjustment factor to be determined by measurement. The adjustment factor m is chosen to make $V_{bg}$ independent of temperature, at least to first order. What makes this possible is that $V_{be1}$ and $\Delta V_{be}$ have opposite dependence on temperature (T) of the p-n junction. $V_{be}$ decreases with temperature, while $\Delta V_{be}$ increases with temperature. For a given technology and bandgap circuit parameters, it is possible to establish a value of m (or values of a set of $m_n$ parameters) in Equation (1) such that the generated $V_{bg}$ is temperature independent or nearly temperature independent to first order within the temperature range of interest, which is typically the expected range of the circuit operation. In a commonly encountered case, a curve of $V_{bg}$ as a function of temperature has a maximum that depends on m. In the vicinity of this maximum, $V_{bg}$ is independent of temperature, to first order.

Alternatively, variations of Equation (1) may be used. For example, to generate a scaled $V_{bg}$, a scaling coefficient m1 may be introduced, as in Equation (2):

$$V_{bg}=m1*(V_{be1}+m*\Delta V_{be})\equiv m1*V_{be1}+m2*\Delta V_{be} \quad \text{Equation (2)}$$

More generally, a bandgap reference voltage $V_{bg}$ may be considered to be a function of two variables, $V_{be}$ and $\Delta V_{be}$. This general relationship may be represented as an infinite sum in a form of a Taylor Series, shown in Equation (3):

$$V_{bg}=\Sigma[m_{nk}*(V_{be})^{n}*(\Delta V_{be})^{k}] \quad \text{Equation (3)}$$

where n and k take on positive integer values 0, 1, 2, . . . etc. and the sum is over all n and k. In practice, the range of n and k may be limited. Thus, Equation (1) is a specific case of the generalization, Equation (3), in which all m-coefficients are equal to zero except for two, one being unity, and another one "m". The method disclosed here may be generalized and is not limited to the use of Equation (1).

An issue with bandgap reference circuits is that they are often designed for a typical integrated circuit fabrication process, with the values for the adjustment factor m fixed for a given design. When a process noticeably deviates from a typical process, which often happens, operating parameters, such as reverse saturation current in a diode or in a BJT, may deviate from the ideal values accordingly. Deviations in these operating parameters, in turn, affect the shape of the bandgap voltage $V_{bg}$ vs. T curve, as well as the absolute value of the bandgap voltage. For extreme deviations of the device parameters, referred to as process corners, the impact may be most apparent. If the process deviation for a particular integrated circuit (IC), such as an application-specific integrated circuit (ASIC) is not known, it is not possible to re-calculate a proper value for m and readjust the bandgap curve without the help of an ideal reference outside of the ASIC.

The amount of variation in $V_{bg}$ value due to process variation of a BJT device may reach as much as 1% of the typical, or central, bandgap voltage value. In addition to that, $V_{bg}$ may be no longer temperature-independent in the temperature range of the interest. In some sensitive applications where a precise voltage reference is highly desired, this amount of bandgap voltage variance will lead to various negative impacts, with various degrees of severity depending on the application. A method and circuitry disclosed here automatically correct the bandgap voltage level for process variations of semiconductor devices having p-n junction, such as BJT's, and stabilize the bandgap voltage temperature performance in the temperature range of interest by adjusting the value of the adjustment factor m depending on process variations. Process variations detected, such as BJT process variations, are internal to an individual integrated circuit, such as an ASIC, without relying on external testing and calibration, which can be expensive and time consuming.

Figure 2:
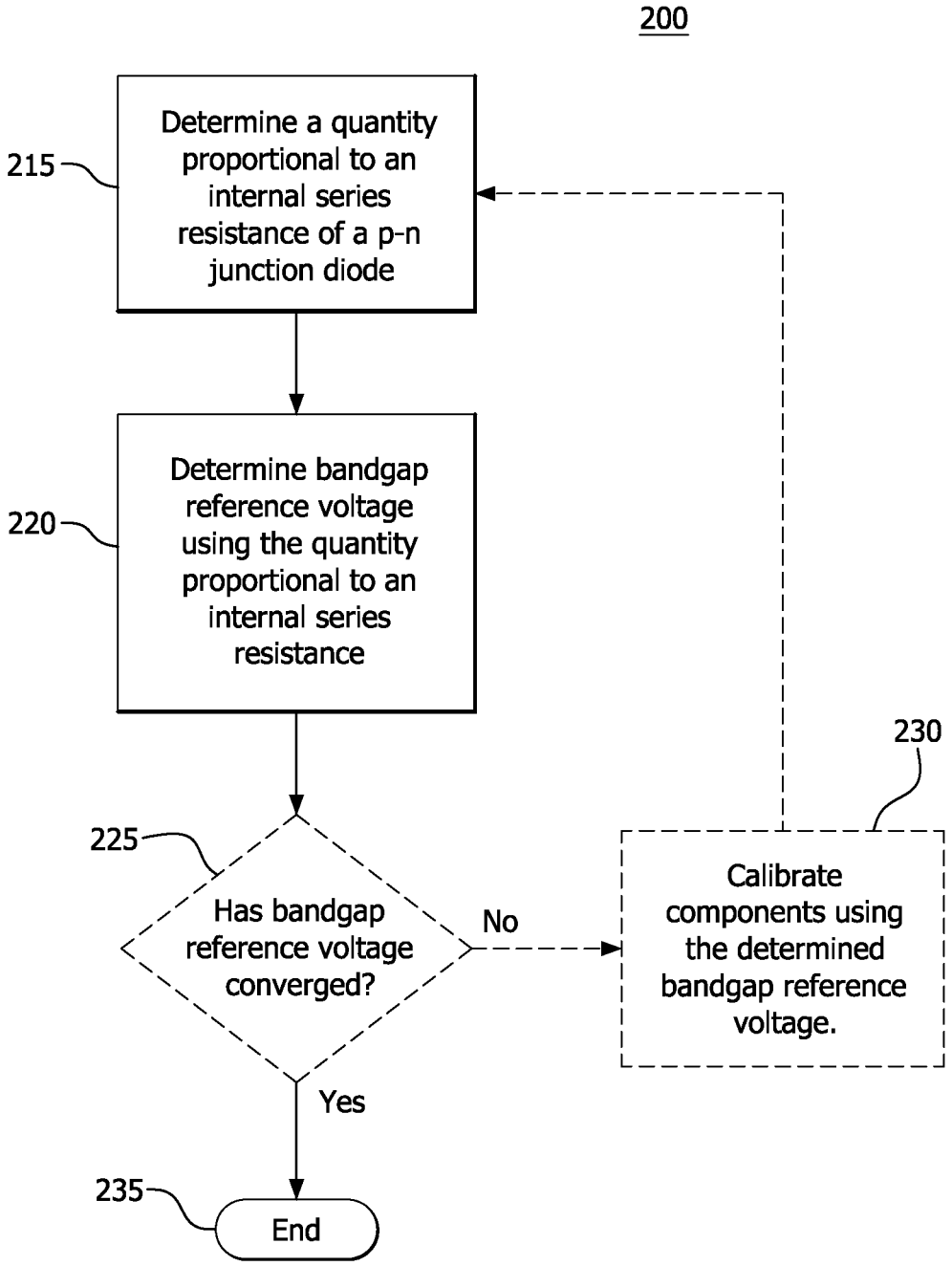
FIG. 2 is a flow chart of an embodiment of a method for determining a temperature-independent bandgap reference voltage.

A method for determining a temperature-independent bandgap reference voltage is shown in FIG. 2. The method 200 includes determining a quantity proportional to an internal series resistance of a p-n junction diode 215; and determining the bandgap reference voltage $V_{bg}$ using the quantity proportional to an internal series resistance of a p-n junction diode 220. Once $V_{bg}$ is determined, the method may end 235.

As described hereinafter, the p-n junction diode may be a base-emitter diode of a BJT, and an internal series resistance of the base-emitter diode may correlate very well with a base resistance of the BJT transistor. The base resistance, in turn, is dependent on the doping concentration in the base and may be used to characterize the effect of process variations of the BJT device on its parameters, such as reverse bias saturation current $I_s$. The use of a quantity proportional to an internal series resistance (well correlated to base resistance) to determine $V_{bg}$ virtually eliminates the effect of BJT process variations on $V_{bg}$, as described hereinafter.

The bandgap reference voltage may be determined 220 by looking up the adjustment factor m in a stored look-up table containing values of the quantity proportional to an internal series resistance of a p-n junction diode and corresponding values of the adjustment factor. The look-up table may be predetermined and stored in a memory.

In some IC's, a component of the bandgap reference circuitry carrying out a method, such as that described hereinbefore, may itself include a device such as an analog-to-digital converter (ADC) that requires a stable voltage reference and includes a circuit providing a bandgap reference voltage. In that case the bandgap reference voltage (the adjustment factor) may be determined using an alternative iterative method, shown by dashed lines in FIG. 2. In an alternative embodiment, a first value of a bandgap reference voltage is determined using an uncalibrated device, such as an ADC, for which a stable reference voltage has only approximately been determined. The first value is determined by steps 215, and 220. A determination is then made whether or not the bandgap reference voltage has converged to a stable value 225. If it has, then the process ends 235. If it has not converged, then the device requiring a stable voltage is calibrated using the current value of the bandgap reference voltage 230. A new bandgap reference voltage is then determined using the calibrated device by returning to step 215. The method may be repeated iteratively until the bandgap reference voltage converges to a stable value as determined in step 225. The method then ends 235.

In an embodiment, not to be considered limiting, a quantity proportional to an internal series resistance of a p-n junction diode may be determined by performing measurements on a base-emitter diode of a bipolar transistor, as follows. The bipolar transistor may be configured as a p-n junction diode by, for example, shorting together the base and collector of the transistor. In this case the transistor is configured as a base-emitter diode. A first forward base-emitter current $I_{be1}$ is applied to the diode and a resulting base-emitter voltage drop $V_{be1}$ is measured. Second and third forward currents $I_{be2}$ and $I_{be3}$ are applied to the diode and resulting base-emitter voltage drops $V_{be2}$ and $V_{be3}$ are respectively measured. A quantity proportional to an internal series resistance of the base-emitter diode is then determined using $V_{be1}$, $V_{be2}$, and $V_{be3}$, as explained in detail hereinafter.

As one of many possible examples, $I_{be2}$ may be set equal to $\alpha*I_{be1}$ and $I_{be3}$ may be set equal to $\alpha*I_{be2}$ where $\alpha$ is greater than 1. The quantity $(V_{be3}-V_{be2})-(V_{be2}-V_{be1})$ is then determined. As shown below, this quantity is proportional to an internal series resistance that correlates strongly with the bipolar transistor base resistance, and may therefore be used to determine the bandgap reference voltage.

The three voltages, $V_{be1}$, $V_{be2}$, and $V_{be3}$, may be determined simultaneously on three separate base-emitter diodes. Alternatively, $V_{be1}$, $V_{be2}$, and $V_{be3}$ may be determined sequentially by supplying a plurality of differing forward currents to a single base-emitter diode. Alternatively, $V_{be1}$, $V_{be2}$, and $V_{be3}$ may be determined using a combination of simultaneous and sequential measurements of forward voltage drops on at least two base-emitter diodes. It is also possible to utilize more than 3 diodes to generate voltages such as $V_{be1}$, $V_{be2}$, and $V_{be3}$.

The method described hereinbefore may be performed upon each powering up of an IC containing circuitry configured to determine a bandgap reference voltage. Once a value of the adjustment factor m is determined, it may be stored in a register included in the IC and used until the IC is reset or powered down. When the IC is reset or powered up again, the method may be repeated.

Figure 3:
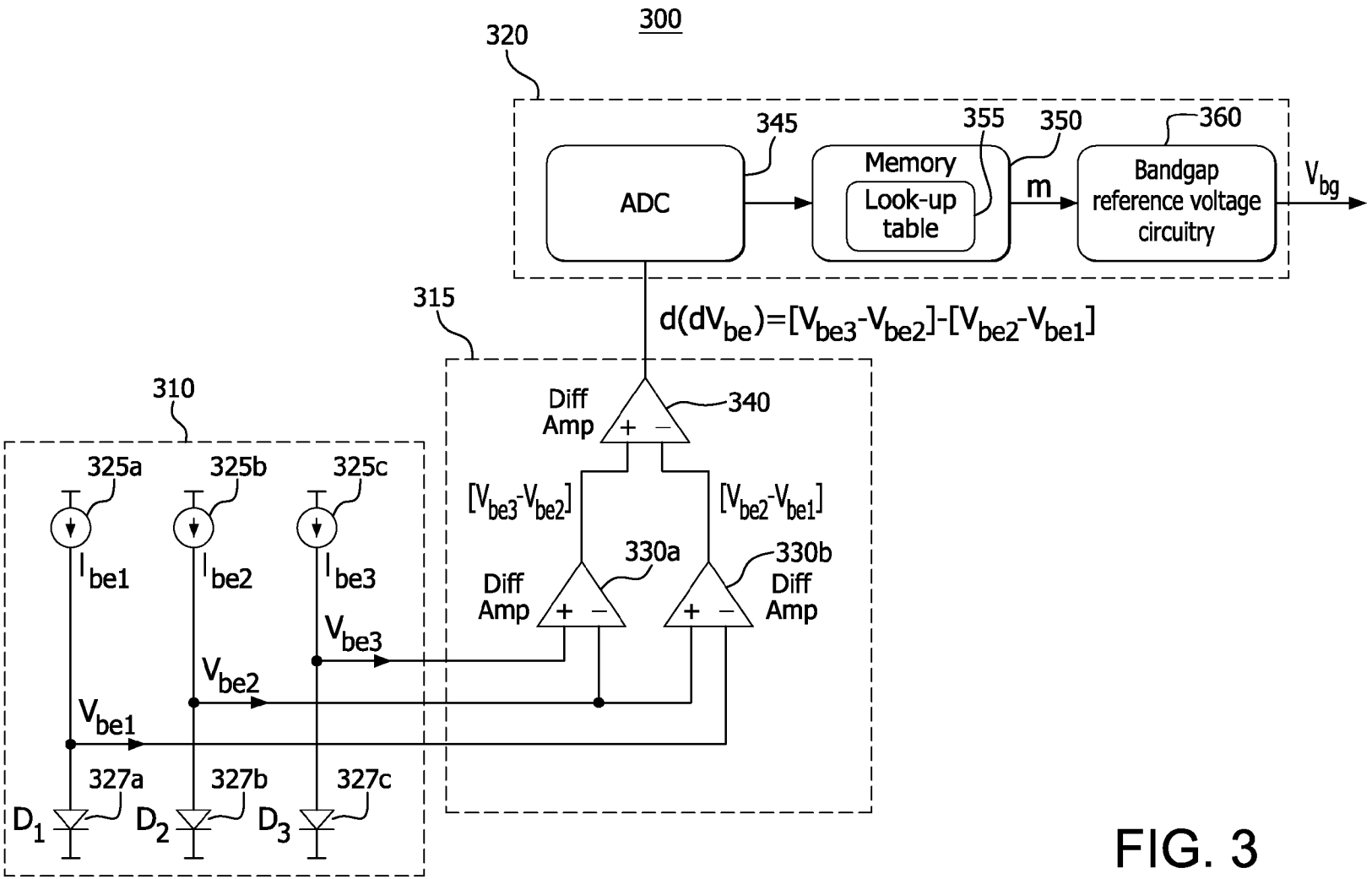
FIG. 3 shows an embodiment of circuitry for determining a temperature-independent bandgap reference voltage.

FIG. 3 shows a schematic of an embodiment of circuitry 300 configured to determine a temperature-independent bandgap reference voltage. The circuitry includes processing circuitry 315 configured to determine a quantity proportional to an internal series resistance of a p-n junction diode, and bandgap circuitry 320 configured to determine a bandgap reference voltage $V_{bg}$, using the quantity proportional to an internal series resistance provided by processing circuitry 315. In an embodiment, bandgap circuitry 320 may include a memory 350 storing a look-up table 355. Look-up table 355 may contain values of the quantity proportional to an internal series resistance and corresponding values of an adjustment factor m. Bandgap circuitry 320 may also include an ADC 345 configured to digitize the quantity proportional to an internal series resistance. Bandgap voltage reference circuitry 360 is configured to obtain a value of the adjustment factor from the look-up table 355, and generate the actual bandgap reference voltage $V_{bg}$ using the adjustment factor.

In an embodiment, also shown in FIG. 3, circuitry 300 includes measurement circuitry 310 configured to perform measurements on at least two p-n junction diodes. In an alternative embodiment, measurement circuitry could be used to perform sequential measurements on a single p-n junction diode. These measurements are used by processing circuitry 315 to determine the quantity proportional to an internal series resistance. The p-n junction diode may include a p-n junction in a transistor, such as a base-emitter diode of a bipolar transistor, but this is not necessary or limiting. In an embodiment, measurement circuitry 310 includes three nominally identical p-n junction diodes 327*a*, 327*b*, and 327*c*, such as bipolar transistor base-emitter diodes. Corresponding current sources 325*a*, 325*b*, and 325*c* supply a forward current, $I_{be1}$, $I_{be2}$, and $I_{be3}$ respectively, to each diode. Current sources 325*a*, 325*b*, and 325*c* and their respective currents may all be derived from a single current source. The forward currents result in respective forward voltage drops $V_{be1}$, $V_{be2}$, and $V_{be3}$ for diodes 327*a*, 327*b*, and 327*c*. In an embodiment of processing circuitry 315, $I_{be2}$ may be set equal to $\alpha*I_{be1}$ and $I_{be3}$ may be set equal to $\alpha*I_{be2}$, where $\alpha>1$. In an embodiment, differential amplifier 330*a* determines a difference between two of the forward voltage drops, $V_{be3}-V_{be2}$. Similarly, differential amplifier 330*b* determines a difference $V_{be2}-V_{be1}$. Outputs of differential amplifiers 330*a* and 330*b* go to inputs of differential amplifier 340, which determines the difference $(V_{be3}-V_{be2})-(V_{be2}-V_{be1})$. As shown below, this latter quantity may be proportional to an internal series resistance of bipolar transistors that include diodes 327*a*, 327*b*, and 327*c* as, for example, base-emitter diodes. The gain of differential amplifiers 330*a*, 330*b*, and 340 is assumed to be unity in the above analysis but this is not necessary and is not limiting.

Circuitry 300 may be configured to determine a temperature-independent bandgap reference voltage upon startup of an electronic device in which the circuitry is included. Circuitry 300 may be configured to determine a bandgap reference voltage iteratively, using an initially uncalibrated component. As an example, ADC 345 may itself require a bandgap reference voltage. In this case, the bandgap reference voltage of ADC 345 may be initially uncalibrated. A first value of a bandgap reference voltage is determined using the uncalibrated ADC, as described hereinbefore. The ADC is then calibrated using the determined first value. A second value of the bandgap reference voltage is then determined using the calibrated ADC component. This process may be repeated until the bandgap reference voltage converges to a single value.

The method and circuitry described hereinbefore for determining a temperature-independent bandgap reference voltage is supported by semiconductor physical properties, as follows. The following description applies to any p-n junction diode and is not limited to p-n junctions in any particular transistor, including a BJT. As stated hereinbefore, a bandgap reference voltage $V_{bg}$ may be defined by Equation (4):

$$V_{bg}=V_{be1}+m*\Delta V_{be} \qquad \text{Equation (4)}$$

where $\Delta V_{be}=V_{be2}-V_{be1}$ and $V_{be2}$ and $V_{be1}$ are voltage drops across a p-n junction diode, such as a base-emitter diode junction in a BJT, produced by forward currents $I_{be2}$ and $I_{be1}$, respectively. In general, the forward voltage drop $V_{be}$ and the forward current $I_d$ for a p-n junction diode are related by $$V_{be}=V_t*\mu*\ln(I_d/I_s)+I_d*R_d. \qquad \text{Equation (5)}$$

In Equation (5), $V_t$ is the thermal voltage k*T/q where k is Boltzman's constant, T is the absolute temperature of the diode and q is the electron charge. The ideality factor $\mu$ is a constant for a given process corner and a range of junction current densities, and has a value between 1 and 2. Resistance $R_d$ may be an internal series resistance of a base-emitter diode of a bipolar junction transistor, or, more generally a series resistance of any p-n junction diode. $I_s$ is the reverse-bias saturation current of the p-n junction.

For sufficiently small current $I_d$, the second term in Equation (5) may be neglected. In that case, Equations (4) and (5) may be combined to give $$V_{bg}=V_t*\mu*\ln(I_{d1}/I_s)+I_{d1}*R_d+m*Vt*\mu*\ln(\alpha) \qquad \text{Equation (6)}$$

where $\alpha=I_{d2}/I_{d1}$. The reverse bias saturation current $I_s$ is very sensitive to process variations and accounts for essentially all of the sensitivity of $V_{bg}$ to process variations of the BJT. (The ideality factor $\mu$ can also contribute to process-related variations of $V_{bg}$ when the junction current density is very low, but for typical ranges of the junction current densities this can be ignored.) For a given junction temperature, the variation of $I_s$ due to process variation of the BJT may be in the range of 30-50% of a typical $I_s$.

In addition, $I_s$ of a particular junction is highly temperature dependent. Although this dependence is rather complex, to the first order of approximation $I_s$ increases exponentially with the absolute temperature T, approximately doubling in its value for every 5 to 8 degree Kelvin increase in the temperature of a silicon junction. Thus, in order to correctly and precisely estimate the value of $I_s$, a precise temperature of the junction must be known with the accuracy better than 1 degree Kelvin. In practice this is all but impossible to achieve since modern on-chip temperature sensors do not guarantee such accuracy, nor is the temperature constant throughout an integrated chip when it is powered up.

The method and circuitry described hereinbefore effectively eliminate these problems of determining $I_s$ by measuring a quantity proportional to an internal series resistance $R_d$, which is strongly correlated with $I_s$ at a given junction temperature. If a value of $R_d$ is estimated accurately, it can be further used to adjust the adjustment factor m in Equation (6) to compensate for process variations of the BJT.

A correlation between $I_s$ and $R_d$ and their dependence on process variation may be shown starting from the equation for the reverse bias saturation current of a PN junction:

$$I_s=e*A*[\mathrm{sqrt}(D_p/\tau_p)*n_i^2/N_d+\mathrm{sqrt}(D_n/\tau_n)*n_i^2/N_a] \quad \text{Equation (7)}$$

where A is the cross-sectional area of the emitter-base junction; $D_p$ and $D_n$ are diffusion constants for positive and negative charge carriers respectively; $\tau_p$ and $\tau_n$ are average lifetimes of the positive and negative carriers respectively; $n_i$ is the intrinsic carrier concentration; and $N_d$ and $N_a$ are the excess carrier concentrations in n-doped side and p-doped side, respectively, of the base-emitter structure. As a non-limiting example, assume the transistor has a p-n-p structure and the p-type emitter is much more highly doped than the n-type base, so that $N_a>>N_d$. If $D_p$ and $D_n$ are of the same order of magnitude, as is the case in silicon, and if $\tau_p$ and $\tau_n$ are also of the same order of magnitude, as is the case in silicon, Equation (7) can be reduced as follows:

$$I_s=e*A*[\mathrm{sqrt}(D_p/\tau_p)*n_i^2/N_d]. \quad \text{Equation (8)}$$

Equation (8) shows that change in the value of $I_s$ due to process variation arises mostly from the variation of the excess donor carrier concentration $N_d$ in the base region of the transistor.

$R_d$ includes the ohmic resistance in the base region, as well as the ohmic resistance in the emitter region, as well as the ohmic resistance of base-metal and emitter-metal contact areas. The base-metal contact resistance typically constitutes a small portion of the $R_d$ and does not change with process variation. Also, because the emitter region of the device is much more highly doped than the base region, the base resistance $R_b$ of the device dominates the emitter resistance $R_e$ of the device. Therefore, the base resistance $R_b$ dominates all other resistances that comprise the internal series resistance $R_d$ of the device. Thus, it is claimed that $R_b$ is strongly correlated to $R_d$. However, the ohmic resistance of the base region will depend on the excess carrier concentration $N_d$ in base, and, therefore, will also be dependent on changes to excess carrier concentration in the base region due to process variation. Therefore, the changes of $I_s$ and $R_d$ parameters due to the process variation of a BJT may be strongly correlated.

A similar corresponding line of reasoning may be used to obtain an equation corresponding to Equation (8) that is applicable to n-p-n transistors, as well as other devices containing p-n junctions including, but not limited to, homojunction p-n diodes, heterojunction diodes, pnp/npn homojunction BJTs, and heterojunction BJTs.

An estimate of $R_d$ may be obtained using an embodiment of the method described hereinbefore, in which three base emitter-currents $I_{be1}$, $I_{be2}$, and $I_{be3}$ are applied, resulting in corresponding voltage drops $V_{be1}$, $V_{be2}$, and $V_{be3}$ being measured. From the junction equation, Equation (5), it may be easily shown that:

$$\Delta V_{be1}\equiv V_{be2}-V_{be1}=V_t*\mu_2*\ln(I_{d2}/I_s)+I_{d2}*R_d-V_t*\mu_1*\ln(I_{d1}/I_s)+I_{d1}*R_d. \quad \text{Equation (9)}$$

For very low current densities, where the current due to carrier recombination constitutes a significant portion of the overall PN junction current, the ideality factor μ will change its value, based on the current density (the value for μ will approach 2 when the PN junction recombination current dominates.) However, if the device currents are high enough to ignore recombination current, the ideality factor μ can be assumed constant at a value approaching unity.

Assuming that $I_{d1}$ current in Equation (9) meets this criterion and letting $I_{d2}=\alpha*I_{d1}$, where $\alpha>1$, gives:

$$\Delta V_{be1}=Vt*\mu*\ln(\alpha)+R_d*I_{d1}*(\alpha-1). \quad \text{Equation (10)}$$

Define a third applied current $I_{d3}=\alpha*I_{d2}=\alpha^2*I_{d1}$. Then, by the same reasoning leading to Equation (10), define $\Delta V_{be2}$ by:

$$\Delta V_{be2}=V_{be3}-V_{be2}=Vt*\mu*\ln(\alpha)+R_d*I_{d1}*(\alpha-1)*\alpha. \quad \text{Equation (11)}$$

Subtracting Equation (10) from Equation (11) yields $$\Delta(\Delta V_{be})\equiv\Delta V_{be2}-\Delta V_{be1}=R_d*I_{d1}*(\alpha-1)^2 \quad \text{Equation (12)}$$

Equation (12) shows that that the difference of $\Delta V_{be}$ voltages does not depend on absolute temperature and, for a fixed $I_{d1}$ and α, is proportional to the internal series resistance $R_d$, and therefore, to a good approximation, also proportional to the base resistance. Thus, by determining a value of $\Delta(\Delta V_{be})$, one may estimate a value for the base resistance of a bipolar transistor. Since there is a direct correlation between this value and the value of the reverse bias saturation current $I_s$, as shown hereinbefore, it is claimed that by measuring $\Delta(\Delta V_{be})$ the amount of the process deviation of the transistor can be established. Based on the amount of the process deviation, one will have a means of adjusting bandgap circuitry to produce close to the ideal bandgap performance. Also, the base resistance does not have a strong temperature dependence, unlike that of $I_s$ current. Therefore, knowledge of precise junction temperature during the base resistance determination procedure is not required. On the other hand, knowledge of the approximate temperature may help establish the dependence of the internal series resistance on temperature when determining the quantity proportional to the internal series resistance.

It should be understood that many variations are possible based on the disclosure herein. For example, a similar method may be used involving different current ratios between $I_{d1}$, $I_{d2}$, and $I_{d3}$. One such example is setting $I_{d2}=\alpha_1*I_{d1}$ and $Id_3=\alpha_2*I_{d2}$, where $\alpha_1$ does not equal $\alpha_2$. Also, more than three BJT junction currents may be used to determine an internal series resistance. With these alternate methods, at least some of the above equations will have to be modified.

Method embodiments and circuitry embodiments described hereinbefore are not necessarily limited to p-n junction diodes in transistors. They may be applied to any p-n junction diode in which one side is more heavily doped than the other. As an example, the more heavily doped side may play the role of the emitter and the more lightly doped side may play the role of the base in the method embodiments and circuitry embodiments as applied to bipolar transistors described hereinbefore.

Although features and elements are described above in particular combinations, each feature or element may be used alone without the other features and elements or in various combinations with or without other features and elements.

The methods provided may be implemented in a general purpose computer, a processor, or a processor core. Suitable processors include, by way of example, a general purpose processor, a special purpose processor, a conventional processor, a digital signal processor (DSP), a plurality of microprocessors, one or more microprocessors in association with a DSP core, a controller, a microcontroller, Application Specific Integrated Circuits (ASICs), Field Programmable Gate Arrays (FPGAs) circuits, any other type of integrated circuit (IC), and/or a state machine. Such processors may be manufactured by configuring a manufacturing process using the results of processed hardware description language (HDL) instructions and other intermediary data including netlists (such instructions capable of being stored on a computer readable media). The results of such processing may be maskworks that are then used in a semiconductor manufacturing process to manufacture a processor which implements aspects of the present invention.

The methods or flow charts provided herein may be implemented in a computer program, software, or firmware incorporated in a computer-readable storage medium for execution by a general purpose computer or a processor. Examples of computer-readable storage mediums include a read only memory (ROM), a random access memory (RAM), a register, cache memory, semiconductor memory devices, magnetic media such as internal hard disks and removable disks, magneto-optical media, and optical media such as CD-ROM disks, and digital versatile disks (DVDs).

What is claimed is:

1. A method for determining a temperature-independent bandgap reference voltage that is compensated for process variations, comprising:

applying a first forward base-emitter current $I_{be1}$ to a p-n junction diode and measuring a resulting voltage drop $V_{be1}$ across the pn junction diode;

applying a second forward base-emitter current $I_{be2}$ to a p-n junction diode and measuring a resulting voltage drop $V_{be2}$ across the p-n junction diode, wherein $I_{be2}$ equals $\alpha I_{be1}$, where $\alpha$ is greater than 1;

applying a third forward base-emitter current $I_{be3}$ to a p-n junction diode and measuring a resulting voltage drop $V_{be3}$ across the pn junction diode, wherein $I_{be3}$ equals $\alpha I_{be2}$;

determining a process-correcting quantity $(V_{be3}-V_{be2})-(V_{be2}-V_{be1})$; and determining the temperature-independent bandgap reference voltage compensated for process variations using the process-correcting quantity.

2. The method of claim 1, wherein determining the temperature-independent bandgap reference voltage comprises looking up an adjustment factor in a stored look-up table, the stored look-up table containing values of the process-correcting quantity and corresponding values of the adjustment factor.

3. The method of claim 1, wherein the method is performed upon startup of an integrated circuit containing circuitry configured to determine a bandgap reference voltage.

4. The method of claim 1, comprising:

determining the bandgap reference voltage using an initially uncalibrated device;

calibrating the initially uncalibrated device using the determined bandgap reference voltage; and determining a new bandgap reference voltage using the calibrated device.

5. The method of claim 4, wherein the device is an analog-to-digital converter.

6. The method of claim 1, wherein the p-n junction diode comprises a bipolar transistor configured as a p-n junction diode.

7. The method of claim 1, wherein $V_{be1}$, $V_{be2}$, and $V_{be3}$ are determined sequentially using a single p-n junction diode.

8. The method of claim 1, wherein $V_{be1}$, $V_{be2}$, and $V_{be3}$ are determined simultaneously on three separate p-n junction diodes.

9. The method of claim 1, wherein $V_{be1}$, $V_{be2}$, and $V_{be3}$ are determined using a combination of simultaneous and sequential measurements of forward voltage drops on at least two p-n junction diodes.

10. Circuitry configured to determine a temperature-independent bandgap reference voltage that is compensated for process variations, comprising:

processing circuitry configured to determine a process-correcting quantity from measurements on a p-n junction diode; and bandgap circuitry configured to determine the temperature-independent bandgap reference voltage using the process-correcting quantity, thereby compensating the determined bandgap reference voltage for process variations;

wherein the process-correcting quantity is $(V_{be3}-V_{be2})-(V_{be2}-V_{be1})$, where $V_{be1}$, $V_{be2}$, and $V_{be3}$ are measured forward voltage drops across a p-n junction diode resulting from application of respective forward currents I, $\alpha$I, and $\alpha^2$I to a p-n junction diode, where a is greater than 1.

11. The circuitry of claim 10, further comprising measurement circuitry configured to perform the measurements on a p-n junction diode.

12. The circuitry of claim 11, wherein the measurement circuitry comprises:

a current source configured to supply the forward currents to at least two p-n junction diodes, resulting in the forward voltage drops for each of the at least two p-n junction diodes; and a differential amplifier configured to measure a difference between forward voltage drops of the at least two p-n junction diodes.

13. The circuitry of claim 12, wherein the processing circuitry is configured to use the difference between forward voltage drops of the at least two p-n junction diodes to determine the process-correcting quantity.

14. The circuitry of claim 12, wherein the bandgap circuitry comprises an analog-to-digital converter (ADC) configured to digitize the difference between the forward voltage drops of at least two of the diodes.

15. The circuitry of claim 11, wherein the measurement circuitry comprises:

a current source configured to supply the forward currents sequentially to the p-n junction diode; and a voltage measuring device configured to measure the forward voltage drops of the p-n junction diode for each of the applied respective forward currents.

16. The circuitry of claim 10, wherein the processing circuitry is configured to use the forward voltage drops to determine the process-correcting quantity.

17. The circuitry of claim 10, wherein the p-n junction diode comprises a bipolar transistor configured as a p-n junction diode, and the circuitry is configured to determine the temperature-independent bandgap reference voltage using the bipolar transistor so configured.

18. The circuitry of claim 10, wherein the bandgap circuitry comprises:

a memory storing a look-up table, the look-up table containing values of the process-correcting quantity and corresponding values of an adjustment factor; and bandgap reference voltage circuitry, wherein the bandgap reference voltage circuitry is configured to:

obtain, from the look-up table, one of the values of the adjustment factor corresponding to a value of the process-correcting quantity; and determine the bandgap reference voltage using the adjustment factor.

19. The circuitry of claim 10, configured to determine the temperature-independent bandgap reference voltage upon startup of an electronic device in which the circuitry is included.

20. The circuitry of claim 10, configured to:

determine a first value of the temperature-independent bandgap reference voltage with an initially uncalibrated component;

calibrate the initially uncalibrated component using the first value of the temperature independent bandgap reference voltage; and determine a second value of the temperature-independent bandgap reference voltage using the calibrated component.

21. A non-transitory computer-readable storage medium comprising:

instructions and data that are acted upon by a program executable on a computer system, the program operating on the instructions and data to perform a portion of a process to fabricate an integrated circuit including circuitry described by the data, the circuitry described by the data comprising:

processing circuitry configured to determine a process-correcting quantity from measurements on a p-n junction diode; and bandgap circuitry configured to determine a bandgap reference voltage using the process-correcting quantity;

wherein the process-correcting quantity is $(V_{be3}-V_{be2})-(V_{be2}-V_{be1})$, where $V_{be1}$, $V_{be2}$ and $V_{be3}$ are measured forward voltage drops across a p-n junction diode resulting from application of respective forward currents I, αI, and $\alpha^2$I to a p-n junction diode, where α is greater than 1.

22. A non-transitory computer-readable storage medium comprising:

instructions and data that are acted upon by a program executable on a computer system, the program operating on the instructions and data to perform a portion of a process to fabricate an integrated circuit including circuitry described by the data, the circuitry described by the data configured to perform a method for determining a temperature-independent bandgap reference voltage, the method comprising:

applying a first forward base-emitter current $I_{be1}$ to a p-n junction diode and measuring a resulting voltage drop $V_{be1}$ across the pn junction diode;

applying a second forward base-emitter current $I_{be2}$ to a p-n junction diode and measuring a resulting voltage drop $V_{be2}$ across the p-n junction diode, wherein $I_{be2}$ equals $\alpha I_{be1}$, where α is greater than 1;

applying a third forward base-emitter current $I_{be3}$ to a p-n junction diode and measuring a resulting voltage drop $V_{be3}$ across the pn junction diode, wherein $I_{be3}$ equals $\alpha I_{be2}$;

determining a process-correcting quantity $(V_{be3}-V_{be2})-(V_{be2}-V_{be1})$; and determining the temperature-independent bandgap reference voltage compensated for process variations using the process-correcting quantity.

23. A device comprising:

a processor;

a memory configured to communicate with the processor;

a storage configured to communicate with the processor;

an input device configured to communicate with the processor; and an output device configured to communicate with the processor;

wherein at least one of the processor, memory, storage, input device, or output device includes circuitry configured to determine a temperature-independent bandgap reference voltage, the circuitry comprising:

processing circuitry configured to determine a process-correcting quantity from measurements on a p-n junction diode; and bandgap circuitry configured to determine the temperature-independent bandgap reference voltage using the process-correcting quantity;

wherein the process-correcting quantity is $(V_{be3}-V_{be2})-(V_{be2}-V_{be1})$, where $V_{be1}$, $V_{be2}$, and $V_{be3}$ are measured forward voltage drops across a p-n junction diode resulting from application of respective forward currents I, αI, and $\alpha^2$I to a p-n junction diode, where α is greater than 1.

24. A device comprising:

a processor;

a memory configured to communicate with the processor;

a storage configured to communicate with the processor;

an input device configured to communicate with the processor; and an output device configured to communicate with the processor;

wherein at least one of the processor, memory, storage, input device, or output device includes circuitry configured to determine a temperature-independent bandgap reference voltage, by executing a method comprising:

applying a first forward base-emitter current $I_{be1}$ to a p-n junction diode and measuring a resulting voltage drop $V_{be1}$ across the pn junction diode;

applying a second forward base-emitter current $I_{be2}$ to a p-n junction diode and measuring a resulting voltage drop $V_{be2}$ across the p-n junction diode, wherein $I_{be2}$ equals $\alpha I_{be1}$, where α is greater than 1;

applying a third forward base-emitter current $I_{be3}$ to a p-n junction diode and measuring a resulting voltage drop $V_{be3}$ across the pn junction diode, wherein $I_{be3}$ equals $\alpha I_{be2}$;

determining a process-correcting quantity $(V_{be3}-V_{be2})-(V_{be2}-V_{be1})$; and determining the temperature-independent bandgap reference voltage using the process-correcting quantity.

25. A method for determining a temperature-independent bandgap reference voltage that is compensated for process variations, the method comprising:

performing measurements on at least one p-n junction;

determine a process-correcting quantity from the measurements; and using the process-correcting quantity to determine the bandgap reference voltage, thereby making the determined bandgap reference voltage insensitive to the process variations;

wherein the process-correcting quantity is $(V_{be3}-V_{be2})-(V_{be2}-V_{be1})$, where $V_{be1}$, $V_{be2}$, and $V_{be3}$ are measured forward voltage drops across a p-n junction diode resulting from application of respective forward currents I, αI, and $\alpha^2$I to a p-n junction diode, where α is greater than 1.

26. The method of claim 25, wherein the at least one p-n junction comprises a base-emitter junction of a bipolar transistor.

* * * * *